US010236553B2

(12) United States Patent
Huang

(10) Patent No.: US 10,236,553 B2
(45) Date of Patent: Mar. 19, 2019

(54) METHOD AND APPARATUS OF COUPLING DIELECTRIC WAVEGUIDE CABLES

(71) Applicant: Tyco Electronics (Shanghai) Co. Ltd., Shanghai (CN)

(72) Inventor: Liang Huang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 19 days.

(21) Appl. No.: 15/374,526

(22) Filed: Dec. 9, 2016

(65) Prior Publication Data

US 2017/0170541 A1 Jun. 15, 2017

(30) Foreign Application Priority Data

Dec. 9, 2015 (CN) ..... 2015 1 0904209

(51) Int. Cl.
*H01P 5/18* (2006.01)
*H01P 3/16* (2006.01)
*H01P 5/02* (2006.01)

(52) U.S. Cl.
CPC ..... *H01P 5/02* (2013.01); *H01P 5/188* (2013.01); *H01P 3/16* (2013.01)

(58) Field of Classification Search
CPC ..... H01P 5/182; H01P 5/02; H01P 3/16
USPC ..... 333/113, 114
See application file for complete search history.

(56) References Cited

U.S. PATENT DOCUMENTS 2,794,959 A * 6/1957 Fox ..... H01P 3/16 324/95
4,091,343 A * 5/1978 Knox ..... H01P 1/16 333/113
4,556,855 A * 12/1985 Chiang ..... H01P 5/188 333/113
9,166,269 B2 * 10/2015 Haroun ..... H01P 3/16
2017/0170540 A1 * 6/2017 Morgan ..... H01P 3/16

* cited by examiner

*Primary Examiner* — Dean Takaoka
(74) *Attorney, Agent, or Firm* — Barley Snyder

(57) ABSTRACT

A method for coupling dielectric waveguide cables is disclosed. The method comprises positioning a first dielectric waveguide cable and a second dielectric waveguide cable such that a first segment of the first dielectric waveguide cable and a second segment of the second dielectric waveguide cable are disposed side by side, generating an electromagnetic coupling between the first segment and the second segment, and transmitting an electromagnetic wave signal from the first dielectric waveguide cable to the second dielectric waveguide cable through the electromagnetic coupling.

15 Claims, 5 Drawing Sheets

METHOD AND APPARATUS OF COUPLING DIELECTRIC WAVEGUIDE CABLES

CROSS-REFERENCE TO RELATED APPLICATION

This application claims the benefit of the filing date under 35 U.S.C. § 119(a)-(d) of Chinese Patent Application No. 201510904209.5, filed on Dec. 9, 2015.

FIELD OF THE INVENTION

The present invention relates to a dielectric waveguide cable, and more particularly, to a method and apparatus for coupling two dielectric waveguide cables.

BACKGROUND

In the prior art, two dielectric waveguide cables are generally connected with each other in a face-to-face connecting manner, which is substantially the same as that of connecting two optical cables. In order to form such a connection, it is necessary to first cut an end face of each of the two dielectric waveguide cables with high precision and then precisely align the end faces of the two dielectric waveguide cables, so that axes of the two dielectric waveguide cables are aligned with each other.

Since it is necessary to cut and align the end faces of the dielectric waveguide cables with high precision to form the prior art connection, cutting and aligning errors must be controlled to below 0.01 mm, which results in a high manufacturing cost.

SUMMARY

An object of the invention, among others, is to provide a method and apparatus which more easily and less expensively couples two dielectric waveguide cables. The disclosed method comprises positioning a first dielectric waveguide cable and a second dielectric waveguide cable such that a first segment of the first dielectric waveguide cable and a second segment of the second dielectric waveguide cable are disposed side by side, generating an electromagnetic coupling between the first segment and the second segment, and transmitting an electromagnetic wave signal from the first dielectric waveguide cable to the second dielectric waveguide cable through the electromagnetic coupling.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
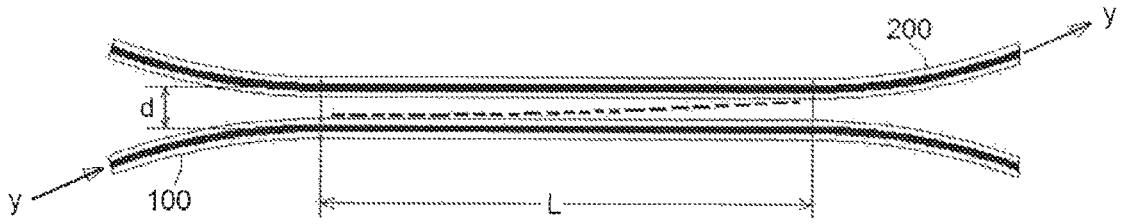
FIG. 1 is a schematic view of a coupling between two adjacent dielectric waveguide cables according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

A method for coupling two dielectric waveguide cables according to an embodiment of the disclosure will be described below with reference to FIGS. 1-4.

Two adjacent dielectric waveguide cables 100, 200 are shown in FIG. 1. A first dielectric waveguide cable 100 and a second dielectric waveguide cable 200 are positioned such that a first segment of the first dielectric waveguide cable 100 (the segment of the first dielectric waveguide cable 100 located within a region denoted by "L" in FIG. 1) and a second segment of the second dielectric waveguide cable 200 (the segment of the second dielectric waveguide cable 200 located within the region denoted by "L" in FIG. 1) are placed side by side. Side surfaces of the dielectric waveguide cables 100, 200 are located adjacent to each other to generate an electromagnetic coupling between the first segment and the second segment. In a coupling region in which the first segment and the second segment are electromagnetically coupled, a length of each of the first and second segment is defined as a coupling length L. A coupling spacing d between centerlines of the first segment and the second segment is less than a maximum distance at which the electromagnetic coupling can be generated.

An electromagnetic wave signal y, shown in FIG. 1, may be transmitted from the first dielectric waveguide cable 100 to the second dielectric waveguide cable 200 through the electromagnetic coupling as denoted by a dashed line in FIG. 1. The dashed line in FIG. 1 is only a visual depiction of the electromagnetic coupling and wave signal y and does not represent a physical or mathematic electromagnetic coupling or electromagnetic transmission.

The coupling length L and the coupling spacing d are set such that the electromagnetic wave signal y within a predetermined operating frequency range is transmitted from the first dielectric waveguide cable 100 to the second dielectric waveguide cable 200 at a minimum loss. In this way, it is possible to ensure the electromagnetic wave signal y is substantially completely transmitted from the first dielectric waveguide cable 100 to the second dielectric waveguide cable 200, thereby ensuring transmission quality of the signal. The coupling length L and the coupling spacing d may be determined based on cross-sectional shapes, geometric dimensions and material property parameters of the first dielectric waveguide cable 100 and the second dielectric waveguide cable 200 as well as an operating frequency of the electromagnetic wave signal.

Figure 2:
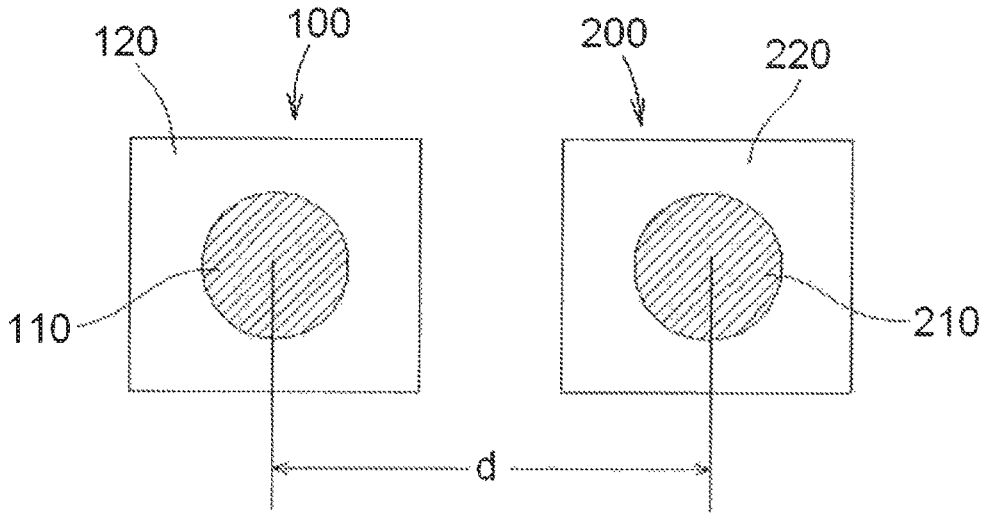
FIG. 2 is a sectional view of the two adjacent dielectric waveguide cables of FIG. 1.

As shown in FIG. 2, the first dielectric waveguide cable 100 has a first fiber core 110 and a first cladding 120 around the first fiber core 110 for protecting the first fiber core 110. The second dielectric waveguide cable 200 has a second fiber core 210 and a second cladding 220 around the second fiber core 210 for protecting the second fiber core 210. In the embodiment shown in FIG. 2, each of the first dielectric waveguide cable 100 and the second dielectric waveguide cable 200 has a rectangular cross-section, and each of the fiber cores 110, 120 of the first dielectric waveguide cable 100 and the second dielectric waveguide cable 200 has a circular cross-section. In other embodiments of the invention, the first dielectric waveguide cable 100 and the second dielectric waveguide cable 200 may have any suitable shape and dimension, such as a circular shape, a rectangular shape, a polygonal shape, an elliptical shape or the like.

Each of the first dielectric waveguide cable 100 and the second dielectric waveguide cable 200 may further comprise an outer protection layer clad around the claddings 120, 220. In this case, before positioning the first dielectric waveguide cable 100 and the second dielectric waveguide cable 200, it is necessary to peel off the outer protection layer of the segment of the first dielectric waveguide cable 100 and the segment of the second dielectric waveguide cable 200 to expose the claddings 120, 220.

An influence of the coupling length L on a signal transmission performance will be described below with reference to an exemplary embodiment of FIGS. 2-4 in a case where the geometric dimensions and the material property parameters of the first dielectric waveguide cable 100 and the second dielectric waveguide cable 200, along with the operating frequency of the electromagnetic wave signal and the coupling spacing d, have been determined.

Figure 3A:
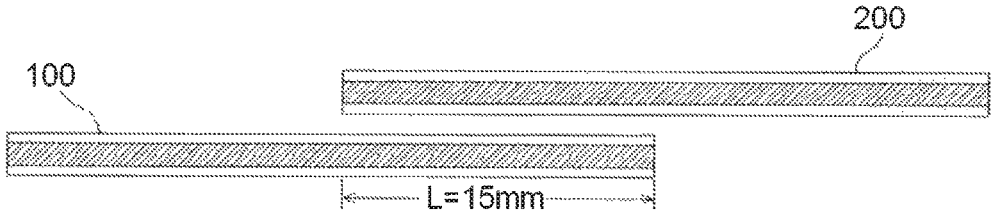
FIG. 3*a* is a schematic view of a coupling between the two adjacent dielectric waveguide cables of FIG. 2.
Figure 3B:
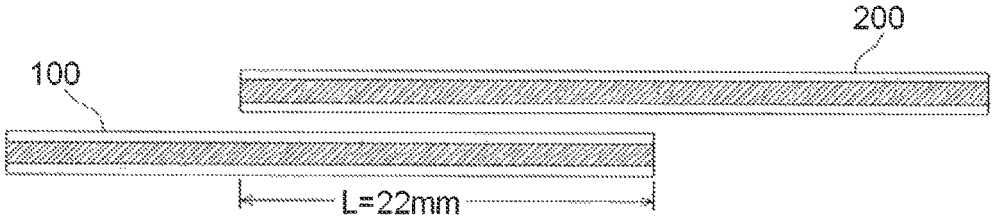
FIG. 3*b* is a schematic view of another coupling between the two adjacent dielectric waveguide cables of FIG. 2.
Figure 3C:
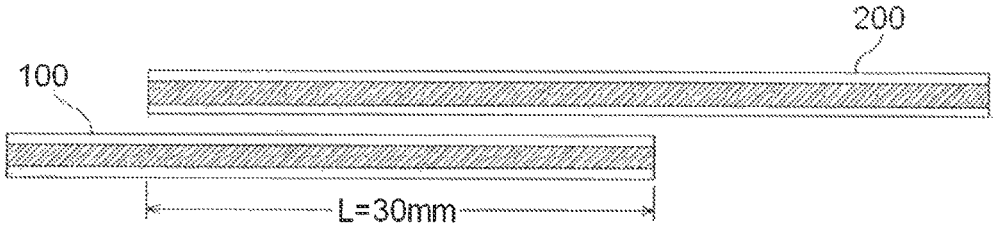
FIG. 3*c* is a schematic view of another coupling between the two adjacent dielectric waveguide cables of FIG. 2.
Figure 4:
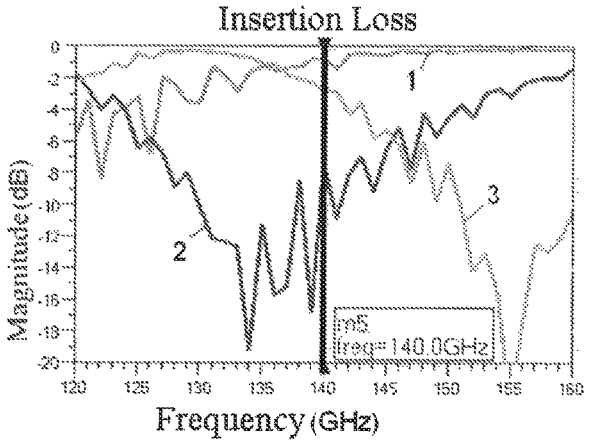
FIG. 4 is a graph of insertion losses of the coupling between the two adjacent dielectric waveguide cables of FIGS. 3*a*-3*c;*

In the embodiments shown in FIGS. 2-4, each of the first dielectric waveguide cable 100 and the second dielectric waveguide cable 200 has a cross-section with sizes of 1 mm×0.8 mm, and each of the fiber cores 110, 210 has a diameter of 0.4 mm. Each of the fiber cores 110, 120 has a relative dielectric permittivity of 2.1 and a loss angle of 0.0002. Each of the claddings 120, 220 has a relative dielectric permittivity of 5.4 and a loss angle of 0.0001. The coupling spacing d between the first dielectric waveguide cable 100 and the second dielectric waveguide cable 200 is 1.1 mm. A central operating frequency of the electromagnetic wave signal is substantially 140 GHz.

FIG. 4 shows insertion losses according to the coupling lengths L shown in FIGS. 3*a*-3*c*; a curve 1 represents the insertion loss when the coupling length L is 15 mm as in FIG. 3*a*, a curve 2 represents the insertion loss when the coupling length L is 22 mm as in FIG. 3*b*, and a curve 3 represents the insertion loss when the coupling length L is 30 mm as in FIG. 3*c*. As shown in FIG. 4, when the central operating frequency of the electromagnetic wave signal is substantially 140 GHz, the insertion loss is minimal when the coupling length L is 15 mm, and the insertion loss is relatively larger when the coupling length L is 22 mm or 30 mm; the insertion loss at a maximum when the coupling length L is 22 mm. In this embodiment, the coupling length L set to 15 mm since the insertion loss is minimal, so that the electromagnetic wave signal can be transmitted from the first dielectric waveguide cable 100 to the second dielectric waveguide cable 200 without any loss.

A method for coupling two dielectric waveguide cables 100', 200' according to another embodiment of the disclosure will be described below with reference to FIGS. 5-7.

Figure 5:
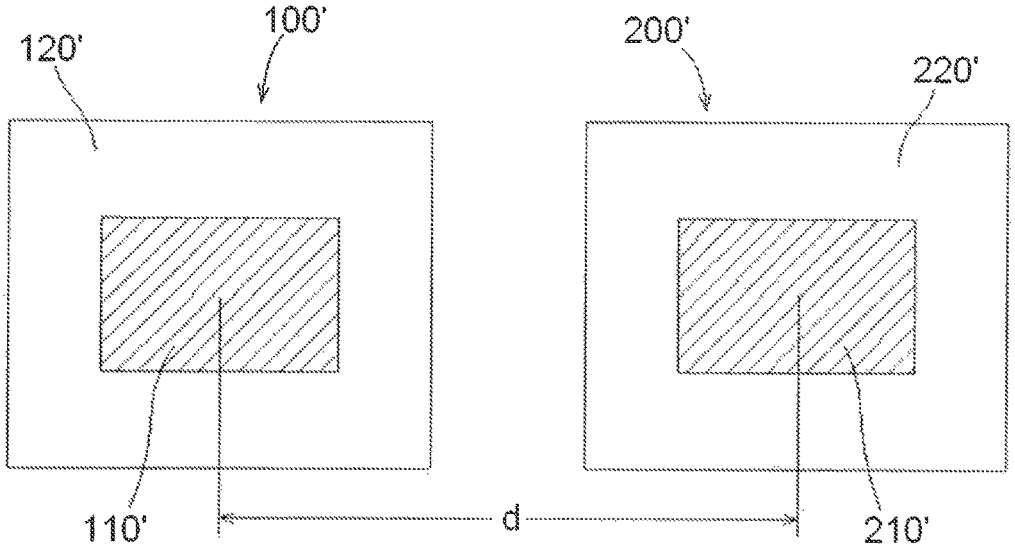
FIG. 5 is a sectional view of two adjacent dielectric waveguide cables according to another embodiment of the invention.

As shown in FIG. 5, a first dielectric waveguide cable 100' has a first fiber core 110' and a first cladding 120' around the first fiber core 110' for protecting the first fiber core 110'. A second dielectric waveguide cable 200' has a second fiber core 210' and a second cladding 220' around the second fiber core 210' for protecting the second fiber core 210'. In the embodiment shown in FIG. 2, each of the first dielectric waveguide cable 100' and the second dielectric waveguide cable 200' has a rectangular cross-section, and each of the fiber cores 110', 120' of the first dielectric waveguide cable 100' and the second dielectric waveguide cable 200' has a rectangular cross-section.

An influence of the coupling length L on a signal transmission performance will be described below with reference to an exemplary embodiment of FIGS. 5-7 in a case where the geometric dimensions and the material property parameters of the first dielectric waveguide cable 100' and the second dielectric waveguide cable 200', along with the operating frequency of the electromagnetic wave signal and the coupling spacing d, have been determined.

In the embodiments shown in FIGS. 5-7, each of the first dielectric waveguide cable 100' and the second dielectric waveguide cable 200' has a cross-section with sizes of 1 mm×0.8 mm, and each of the fiber cores 110', 210' has a cross-section with sizes of 0.2 mm×0.4 mm. Each of the fiber cores 110', 120' has a relative dielectric permittivity of 2.14 and a loss angle of 0.0001, Each of the claddings 120', 220' has a relative dielectric permittivity of 5.4 and a loss angle of 0.0002. The coupling spacing d between the first dielectric waveguide. cable 100' and the second dielectric waveguide cable 200' is 1.1 mm. A central operating frequency of the electromagnetic wave signal is substantially 140 GHz.

Figure 6A:
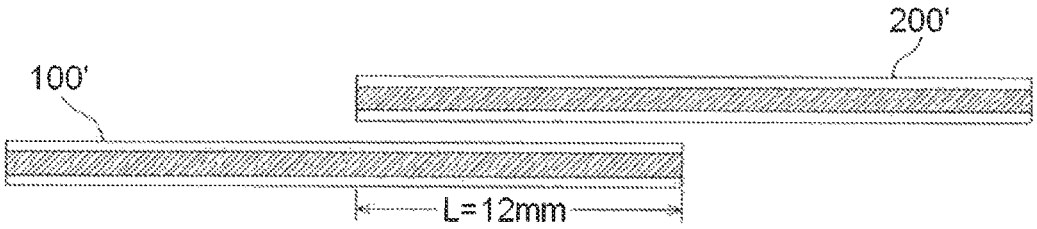
FIG. 6*a* is a schematic view of a coupling between the two adjacent dielectric waveguide cables of FIG. 5.
Figure 6B:
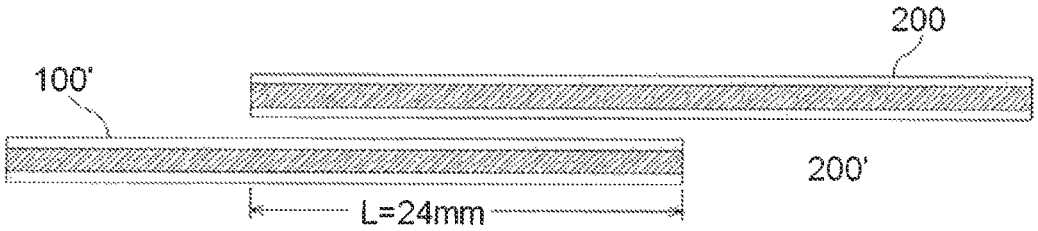
FIG. 6*b* is a schematic view of another coupling between the two adjacent dielectric waveguide cables of FIG. 5.
Figure 7A:
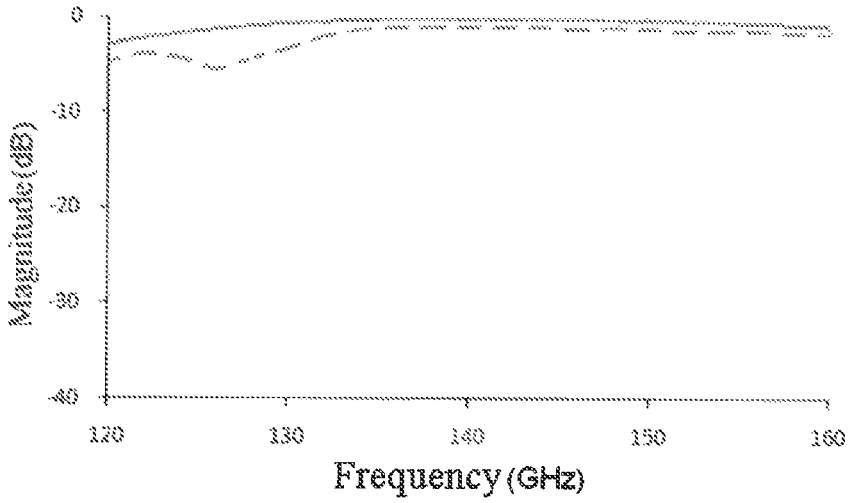
FIG. 7*a* is a graph of theoretical insertion loss and actual insertion loss of the coupling between the two adjacent dielectric waveguide cables of FIG. 6*a*.
Figure 7B:
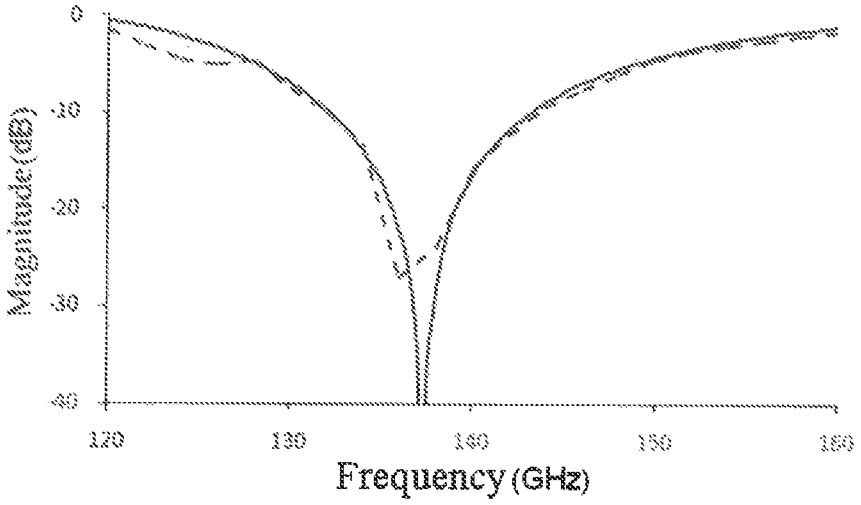
FIG. 7*b* is a graph of theoretical insertion loss and actual insertion loss of the coupling between the two adjacent dielectric waveguide cables of FIG. 6*b*.

FIGS. 7*a* and 7*b* show a theoretical insertion loss (denoted by the solid line) and an actual insertion loss (denoted by the dashed line) when the two adjacent dielectric waveguide cables 100', 200' are coupled to one another according to the coupling lengths L shown in FIGS. 6*a* and 6*b*.

As shown in FIG. 7*a*, when the coupling length L is 12 mm as shown in FIG. 6*a* and the central operating frequency of the electromagnetic wave signal is substantially 140 GHz, the actual insertion loss is minimal and is substantially coincident with the theoretical insertion loss. As shown in FIG. 7*b*, when the coupling length L is 24 mm as shown in FIG. 6*b* and the central operating frequency of the electromagnetic wave signal is substantially 140 GHz, the actual insertion loss is relatively large, and a relatively large difference exists between the actual insertion loss and the theoretical insertion loss. In this embodiment, the coupling length L is set at 12 mm since the insertion loss is minimal and the electromagnetic wave signal can be transmitted from the first dielectric waveguide cable 100' to the second dielectric waveguide cable 200' without any loss.

An apparatus for coupling two dielectric waveguide cables 100, 200 according to the invention comprises a holding device adapted to position the first dielectric waveguide cable 100 and the second dielectric waveguide cable 200 such that the first segment and the second segment are disposed side by side with side surfaces located adjacent to each other. An electromagnetic wave signal is transmitted from the first dielectric waveguide cable 100 to the second dielectric waveguide cable 200 through electromagnetic coupling between the segments.

The holding device comprises a first positioning member having a first positioning groove adapted to position the first dielectric waveguide cable 100 and a second positioning member having a second positioning groove adapted to position the second dielectric waveguide cable 200. The first positioning member and the second positioning member may be disposed to be movable in a first direction relative to each other so as to adjust the coupling length L between the segment of the first dielectric waveguide cable 100 and the segment of the second dielectric waveguide cable 200. The first positioning member and the second positioning member may be disposed to be movable in a second direction perpendicular to the first direction relative to each other so as to adjust the coupling spacing d between the first segment and the second segment. The holding device may also comprise a gripping mechanism for gripping the first dielectric waveguide cable 100 and the second dielectric waveguide cable 200.

Advantageously, according to the embodiments of the invention, two adjacent dielectric waveguide cables 100, 200 are coupled by positioning the two dielectric waveguide cables 100, 200 side by side, without requiring cutting and aligning end faces with a high precision. The electromagnetic wave signal can be transmitted between the two dielectric waveguide cables 100, 200 through adjusting the coupling length L and the coupling spacing d, therefore, it is possible to reduce the difficulty and cost of coupling dielectric waveguide cables.

What is claimed is:

1. A method for coupling dielectric waveguide cables, comprising:

positioning a first dielectric waveguide cable having a circular, polygonal or elliptical cross-section and a fiber core, the fiber core having a circular, polygonal or elliptical cross-section and a cladding around the fiber core and an outer protection layer disposed around the cladding and a second dielectric waveguide cable having a circular, polygonal or elliptical cross-section and a fiber core, the fiber core having a circular, polygonal or elliptical cross-section and a cladding around the fiber core and an outer protection layer disposed around the cladding and peeling off the outer protection layer of the first segment and the second segment before positioning the first dielectric waveguide cable and the second dielectric waveguide cable such that a first segment of the first dielectric waveguide cable and a second segment of the second dielectric waveguide cable are disposed side by side;

generating an electromagnetic coupling between the first segment and the second segment; and transmitting an electromagnetic wave signal from the first dielectric waveguide cable to the second dielectric waveguide cable through the electromagnetic coupling.

2. The method of claim 1, wherein a side surface of the first dielectric waveguide cable is located adjacent a side surface of the second dielectric waveguide cable.

3. The method of claim 1, wherein the first segment and the second segment are electromagnetically coupled in a coupling region.

4. The method of claim 3, wherein each of the first segment and the second segment have a coupling length in an axial direction in the coupling region.

5. The method of claim 4, wherein a centerline of the first segment and a centerline of the second segment are spaced apart by a coupling spacing in the coupling region.

6. The method of claim 5, further comprising determining the coupling length and the coupling spacing such that the electromagnetic wave signal within a predetermined operating frequency range is transmitted from the first dielectric waveguide cable to the second dielectric waveguide cable at a minimum loss.

7. The method of claim 6, wherein the coupling length and the coupling spacing are determined based on cross-sectional shapes, geometric dimensions, and material properties of the first dielectric waveguide cable and the second dielectric waveguide cable.

8. The method of claim 7, wherein the coupling length and the coupling spacing are determined based on an operating frequency of the electromagnetic wave signal.

9. An apparatus for coupling dielectric waveguide cables, comprising:

a holding device positioning a first dielectric waveguide cable having a first segment and an outer protection layer peeled off from the first segment and a second dielectric waveguide cable having a second segment and an outer protection layer peeled off from the second segment such that a first segment of the first dielectric waveguide cable and a second segment of the second dielectric waveguide cable are disposed side by side, an electromagnetic wave signal transmitted from the first dielectric waveguide cable to the second dielectric waveguide cable through an electromagnetic coupling between the first segment and the second segment.

10. The apparatus of claim 9, wherein the first segment and the second segment are electromagnetically coupled in a coupling region, each of the first segment and the second segment have a coupling length in an axial direction in the coupling region, and a centerline of the first segment and a centerline of the second segment are spaced apart by a coupling spacing in the coupling region.

11. The apparatus of claim 10, wherein the coupling length and the coupling spacing are set such that the electromagnetic wave signal within a predetermined operating frequency range is transmitted from the first dielectric waveguide cable to the second dielectric waveguide cable at a minimum loss.

12. The apparatus of claim 11, wherein the coupling length and the coupling spacing are determined based on cross-sectional shapes, geometric dimensions, and material properties of the first dielectric waveguide cable and the second dielectric waveguide cable and an operating frequency of the electromagnetic wave signal.

13. The apparatus of claim 12, wherein the holding device comprises a first positioning member having a first positioning groove adapted to position the first dielectric waveguide cable and a second positioning member having a second positioning groove adapted to position the second dielectric waveguide cable.

14. The apparatus of claim 13, wherein the first positioning member and the second positioning member are movable in a first direction relative to each other to adjust the coupling length.

15. The apparatus of claim 14, wherein the first positioning member and the second positioning member are movable in a second direction perpendicular to the first direction relative to each other to adjust the coupling spacing.

* * * * *